US009991585B2

(12) United States Patent
Li et al.

(10) Patent No.: US 9,991,585 B2
(45) Date of Patent: Jun. 5, 2018

(54) ANTENNA APPARATUS AND TERMINAL

(71) Applicant: Huawei Device (Dongguan) Co., Ltd., Dongguan (CN)

(72) Inventors: Yuanpeng Li, Beijing (CN); Yafang Yu, Beijing (CN); Meng Hou, Shanghai (CN)

(73) Assignee: Huawei Device (Dongguan) Co., Ltd., Dongguan (CN)

( * ) Notice: Subject to any disclaimer, the term of this patent is extended or adjusted under 35 U.S.C. 154(b) by 0 days. days.

(21) Appl. No.: 15/307,316

(22) PCT Filed: Apr. 28, 2014

(86) PCT No.: PCT/CN2014/076386

§ 371 (c)(1),
(2) Date: Oct. 27, 2016

(87) PCT Pub. No.: WO2015/165007

PCT Pub. Date: Nov. 5, 2015

(65) Prior Publication Data

US 2017/0047642 A1 Feb. 16, 2017

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/38* (2013.01); *H01Q 1/48* (2013.01); *H01Q 5/10* (2015.01);
(Continued)

(58) Field of Classification Search
CPC ..... H01Q 1/38; H01Q 5/10; H01Q 5/364; H01Q 1/243; H01Q 1/48; H01Q 5/371; H01Q 9/0421; H01Q 9/42; H01Q 1/24
See application file for complete search history.

(56) References Cited

U.S. PATENT DOCUMENTS 7,012,573 B2 * 3/2006 Tchistiakov ..... H01Q 1/38 343/795
7,050,010 B2 * 5/2006 Wang ..... H01Q 1/22 343/700 MS
(Continued)

FOREIGN PATENT DOCUMENTS

CN 1508907 A 6/2004
CN 101958460 A 1/2011
(Continued)

*Primary Examiner* — Tho G Phan

(57) ABSTRACT

An antenna apparatus and a terminal. The antenna apparatus includes an antenna body and at least one stub. The antenna body includes a first branch used to radiate a high-frequency signal and a second branch used to radiate a low-frequency signal. One end of the stub is connected to a connection point of the second branch, and the other end of the stub is a free end. The connection point is a position with a maximum value of current distribution on the second branch of an electromagnetic wave having a wavelength. The wavelength corresponds to a specified high frequency at which the antenna apparatus works. The length of the stub is determined according to the wavelength corresponding to the specified high frequency.

20 Claims, 6 Drawing Sheets

(51) Int. Cl.

| | |
|---|---|
| ***H01Q 5/10*** | (2015.01) |
| ***H01Q 5/364*** | (2015.01) |
| ***H01Q 1/48*** | (2006.01) |
| ***H01Q 9/04*** | (2006.01) |
| ***H01Q 9/42*** | (2006.01) |
| ***H01Q 5/371*** | (2015.01) |

(52) U.S. Cl.
CPC ..... *H01Q 5/364* (2015.01); *H01Q 5/371* (2015.01); *H01Q 9/0421* (2013.01); *H01Q 9/42* (2013.01)

(56) References Cited

U.S. PATENT DOCUMENTS

| | | | | |
|---|---|---|---|---|
| 7,196,665 | B2 * | 3/2007 | Koshi | H01Q 9/0414 343/700 MS |
| 7,352,329 | B2 * | 4/2008 | Chung | H01Q 1/243 343/700 MS |
| 7,884,769 | B2 * | 2/2011 | Boyle | H01Q 1/243 343/700 MS |
| 8,643,549 | B2 * | 2/2014 | Yamaki | H01Q 5/00 343/700 MS |
| 9,276,320 | B2 * | 3/2016 | Wu | H01Q 1/243 |
| 9,647,320 | B2 * | 5/2017 | Lin | H01Q 1/243 |
| 2004/0222923 | A1 | 11/2004 | Erkocevic | |
| 2005/0078034 | A1 | 4/2005 | Imaizumi et al. | |
| 2005/0128151 | A1 | 6/2005 | Kwak et al. | |
| 2009/0221243 | A1 | 9/2009 | Egawa et al. | |
| 2010/0039344 | A1 | 2/2010 | Chang | |
| 2011/0205138 | A1 | 8/2011 | Yanagi et al. | |
| 2012/0026057 | A1 | 2/2012 | Teshima | |
| 2013/0049900 | A1 | 2/2013 | Chung et al. | |
| 2013/0285870 | A1 | 10/2013 | Hotta et al. | |

FOREIGN PATENT DOCUMENTS

| | | | |
|---|---|---|---|
| CN | 102820517 | A | 12/2012 |
| CN | 103636064 | A | 3/2014 |
| JP | H05145324 | A | 6/1993 |
| JP | 2004096464 | A | 3/2004 |
| JP | 2004112397 | A | 4/2004 |
| JP | 2005167730 | A | 6/2005 |
| JP | 2006165608 | A | 6/2006 |
| JP | 2009253886 | A | 10/2009 |
| JP | 2010288175 | A | 12/2010 |
| JP | 2011176653 | A | 9/2011 |
| JP | 2013017112 | A | 1/2013 |
| JP | 2013048396 | A | 3/2013 |
| JP | 2013229823 | A | 11/2013 |
| KR | 100724434 | B1 | 5/2007 |
| WO | 2005062422 | A1 | 7/2005 |

* cited by examiner

ANTENNA APPARATUS AND TERMINAL

CROSS-REFERENCE TO RELATED APPLICATIONS

The present application claims priority under 35 U.S.C. § 365 to International Patent Application No. PCT/CN2014/076386 filed Apr. 28, 2014, which is incorporated herein by reference into the present disclosure as if fully set forth herein.

TECHNICAL FIELD

The present invention relates to communications technologies, and in particular, to an antenna apparatus and a terminal.

BACKGROUND

With commercial use of the $4^{th}$ generation mobile communication technology (4G), development of handheld mobile terminals more tends towards ultra-thinness, multi-function, large battery capacity, and the like, which imposes an increasingly higher requirement on antenna products of the mobile terminals.

In technical solutions of Long Term Evolution (LTE) antennas, one solution is that a planar inverted F antenna (PIFA) evolving from a microstrip antenna having one short-circuited end is used as a terminal antenna. To cover more frequency bands, in the prior art, generally a parasitic branch may be added, that is, a quantity of branches used to radiate high-frequency signals may be increased, or the length of a branch used to radiate a low-frequency signal may be increased, so as to cover a corresponding high frequency by using a higher order mode of a low frequency.

However, regardless of whether a parasitic branch is added or the length of a low-frequency branch is increased, the antenna has relatively poor performance when occupying relatively small terminal space.

SUMMARY

Embodiments of the present invention provide an antenna apparatus and a terminal, so as to resolve a problem in the prior art that a terminal antenna has relatively poor performance when occupying relatively small terminal space.

According to a first aspect of the embodiments of the present invention, an antenna apparatus is provided, including: an antenna body and at least one stub, where the antenna body includes a first branch used to radiate a high-frequency signal and a second branch used to radiate a low-frequency signal; and one end of the stub is connected to a connection point of the second branch, and the other end of the stub is a free end; the connection point is a position with a maximum value of current distribution on the second branch of a wavelength corresponding to a specified high frequency at which the antenna apparatus works; and the length of the stub is determined according to the wavelength corresponding to the specified high frequency.

In a first possible implementation manner, according to the first aspect, a first feeding connection end is disposed on the first branch, and a second feeding connection end is disposed on the second branch.

In a second possible implementation manner, according to the first aspect, a ground connection end is disposed on the first branch, and a third feeding connection end is disposed on the second branch.

In a third possible implementation manner, with reference to the first aspect, the first possible implementation manner, and the second possible implementation manner, the free end of the stub is near the second branch.

In a fourth possible implementation manner, with reference to the first aspect, the first possible implementation manner, the second possible implementation manner, and the third possible implementation manner, the antenna apparatus further includes a filtering matching device connected to the free end of the stub.

According to a second aspect of the embodiments of the present invention, a terminal is provided, including: a printed circuit board and any antenna apparatus according to the first aspect, where a feeder and a ground end are disposed on the printed circuit board; and the first branch in the antenna apparatus is connected to the feeder, and the second branch is connected to the feeder, or the first branch in the antenna apparatus is connected to the ground end, and the second branch is connected to the feeder.

An antenna apparatus provided in an embodiment of the present invention includes an antenna body and at least one stub, where the antenna body includes a first branch used to radiate a high-frequency signal and a second branch used to radiate a low-frequency signal; one end of the stub is connected to a connection point of the second branch, and the other end of the stub is a free end; the connection point is a position with a maximum value of current distribution on the second branch of a wavelength corresponding to a specified high frequency at which the antenna apparatus works; and the length of the stub is determined according to the wavelength corresponding to the specified high frequency. As compared with a parasitic branch in the prior art, the foregoing stub occupies smaller space, and the foregoing stub can increase coverage bandwidth and efficiency of high frequencies and low frequencies of an antenna apparatus. Therefore, the antenna apparatus has better performance while occupying a relatively small area.

BRIEF DESCRIPTION OF THE DRAWINGS

To describe the technical solutions in the embodiments of the present invention or in the prior art more clearly, the following briefly describes the accompanying drawings required for describing the embodiments or the prior art. Apparently, the accompanying drawings in the following description show some embodiments of the present invention, and a person of ordinary skill in the art may still derive other drawings from these accompanying drawings without creative efforts.

DETAILED DESCRIPTION

To make the objectives, technical solutions, and advantages of the embodiments of the present invention clearer, the following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

Figure 1:
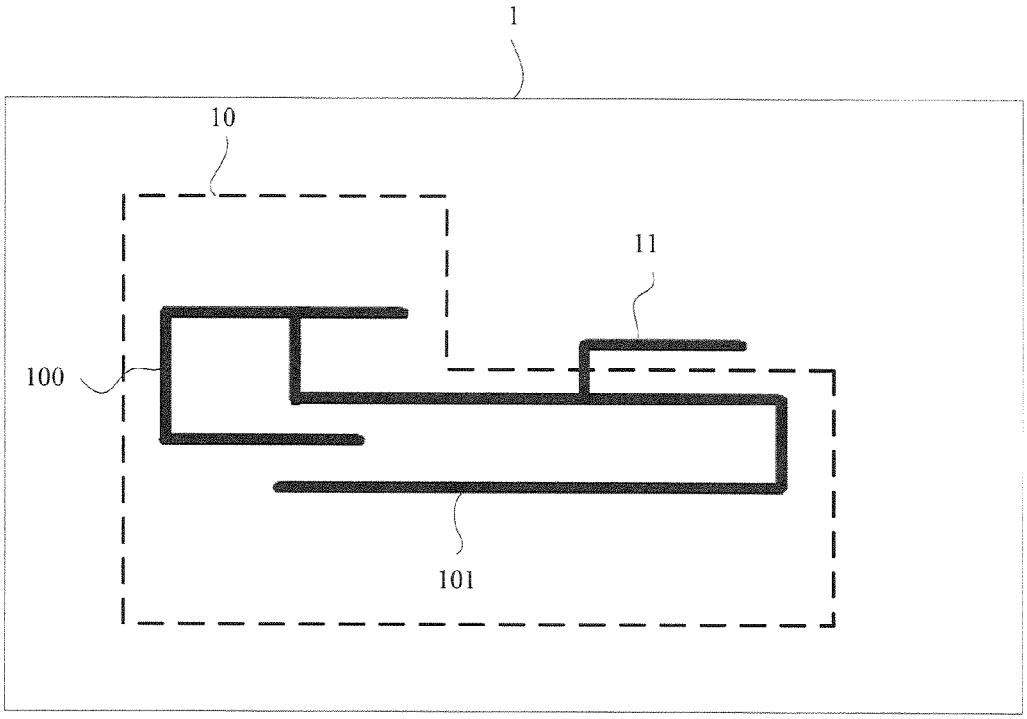
FIG. 1 is a schematic structural diagram of an antenna apparatus according to Embodiment 1 of the present invention.

FIG. 1 is a schematic structural diagram of an antenna apparatus according to Embodiment 1 of the present invention. As shown in FIG. 1, the antenna apparatus 1 includes an antenna body 10 and a stub 11.

Specifically, the antenna body 10 includes a first branch 100 used to radiate a high-frequency signal and a second branch 101 used to radiate a low-frequency signal. For example, in a practical application, the high-frequency signal may be a $3^{rd}$ generation mobile communication technology ($3^{rd}$-Generation, 3G for short) signal of 1.575 Giga Hertz (GHz) to 2.17 GHz, and the low-frequency signal may be a Global System for Mobile Communications (Global System for Mobile Communications, GSM for short) signal in a frequency range of 820 Mega Hertz (MHz) to 960 MHz. In practice, the foregoing first branch 100 may be several metal conducting wires that are shorter than the second branch 101; the second branch 101 may be several metal conducting wires that are longer than the first branch 100; and a quantity of the metal conducting wires forming the first branch 100 and a quantity of the metal conducting wires forming the second branch 101 are not limited herein.

Optionally, the antenna body 10 may be an inverted F antenna (Inverted F Antenna, IFA for short), and in particular, the antenna body 10 may be a planar inverted F antenna (PIFA).

Further, the antenna apparatus 1 limits a disposing position and the length of the stub 11.

Regarding the position, one end of the stub 11 is connected to a connection point of the second branch 101, and the other end of the stub 11 is a free end. The foregoing connection point is a position with a maximum value of current distribution on the second branch 101 of a wavelength corresponding to a specified high frequency at which the antenna apparatus 1 works. For example, a product of a wavelength and a frequency is equal to the speed of light; therefore, after a specified high frequency is determined, a wavelength corresponding to the specified high frequency is determined by dividing the speed of light by the specified high frequency; and after the wavelength is determined, current distribution on the second branch 101 of an electromagnetic wave of the wavelength may be determined according to a feeding mode and boundary conditions of the stub 11, so as to determine a maximum value of the current distribution.

Regarding the length, the length of the stub 11 is determined according to the wavelength corresponding to the specified high frequency. It can be known from the description in the previous paragraph that after the specified high frequency is determined, the wavelength corresponding to the specified high frequency is also determined. Moreover, the length of the stub 11, that is, the actual physical length of the stub 11, may generally equal a multiple of the wavelength, and the multiple is the electrical length. Specifically, the electrical length is a ratio of the actual physical length of the stub 11 to the wavelength corresponding to the specified high frequency, that is, is the actual physical length of the stub 11 divided by the wavelength corresponding to the specified high frequency at which the antenna apparatus 1 works. In practice, the electrical length of the stub 11 may be determined according to an area that needs to be covered by the antenna apparatus 1, space occupied by the antenna apparatus 1, impedance distribution of the stub 11, and the like. To ensure a coverage area and radiation efficiency of the antenna apparatus 1, the foregoing electrical length generally does not exceed ½, that is, the actual physical length of the stub 11 generally does not exceed ½ of the wavelength corresponding to the specified high frequency. For example, the foregoing stub 11 may be made into a dipole antenna whose electrical length is ¼, that is, the actual physical length of the stub 11 is ¼ of the wavelength corresponding to the specified high frequency.

In practice, the specified high frequency at which the antenna apparatus 1 works may be determined according to a frequency band at which the antenna apparatus 1 needs to actually work, for example, a relatively low frequency in a high frequency band at which the antenna apparatus 1 works may be selected as the foregoing specified high frequency.

It shall be noted that the antenna apparatus 1 including one stub 11 is only used as an example herein, but the present invention is not limited thereto. That is, after a specified high frequency is selected, the specified high frequency may correspond to a wavelength because a product of a wavelength and a frequency is equal to the speed of light. Moreover, after the wavelength is determined, a diagram of current distribution on the second branch 101 may be determined. There may be more than one maximum value of current distribution, and therefore, a quantity of stubs 11 may be greater than one. The specific quantity of the stubs may be determined according to a frequency range that needs to be covered by the antenna apparatus 1 in practice. Besides, in practice, the material of the stub 11 is the same as the material for making an antenna in the prior art, such as, a copper plated material, or an alloy. Moreover, a direction that the stub 11 faces is not limited herein, that is, a position of the stub 11 relative to the first branch 100, that is, the stub 11 may be disposed at an external side of the first branch 100 or may be disposed at an internal side of the first branch 100.

How a stub 11 improves performance of an antenna apparatus 1 is briefly described below. For a high-frequency signal, if there is only a first branch 100, the first branch 100 produces resonance at only one high frequency band. After a stub 11 is added to a second branch 101 used to radiate a low frequency signal, the stub 11 may function to match radiation performed on a high frequency signal because the stub 11 may regulate high-frequency current distribution, so that the first branch 100 synchronously produces resonance at two high frequency bands. For example, if a first branch 100 of an antenna apparatus 1 is designed to produce one high frequency, the antenna apparatus 1 may cover 1710 MHz to 2170 MHz, and if the antenna apparatus 1 needs to cover a higher frequency band, such as an LTE frequency band of 2300 MHz to 2700 MHz, the objective of covering the foregoing LTE frequency band may be achieved by adjusting the length of a stub 11 and a position of the stub 11 on the second branch 101. Certainly, when more than one stub 11 is added, resonance may be produced at more high frequency bands. For a low-frequency signal, addition of a stub 11 may directly increase radiation resistance at a low frequency. Moreover, the stub 11 can radiate the signal, so that a coverage area of a low-frequency electric field is expanded and low-frequency bandwidth and efficiency are increased.

It can be seen that in the antenna apparatus 1 provided in the embodiment of the present invention, if the same bandwidth is to be covered, a solution of adding a stub 11 relates to smaller occupied space as compared with a solution of adding a parasitic branch. If an occupied area in the solution of adding a stub 11 is the same as an occupied area in the solution of adding a parasitic branch, the solution of adding a stub 11 results in wider bandwidth coverage and higher antenna efficiency. Therefore, the antenna apparatus 1 provided in the embodiment of the present invention may provide better antenna performance while occupying a relatively small area. Moreover, as compared with an antenna with a switch, the antenna apparatus 1 provided in the embodiment of the present invention is low in design complexity, and antenna radiation efficiency is improved.

Figure 2A:
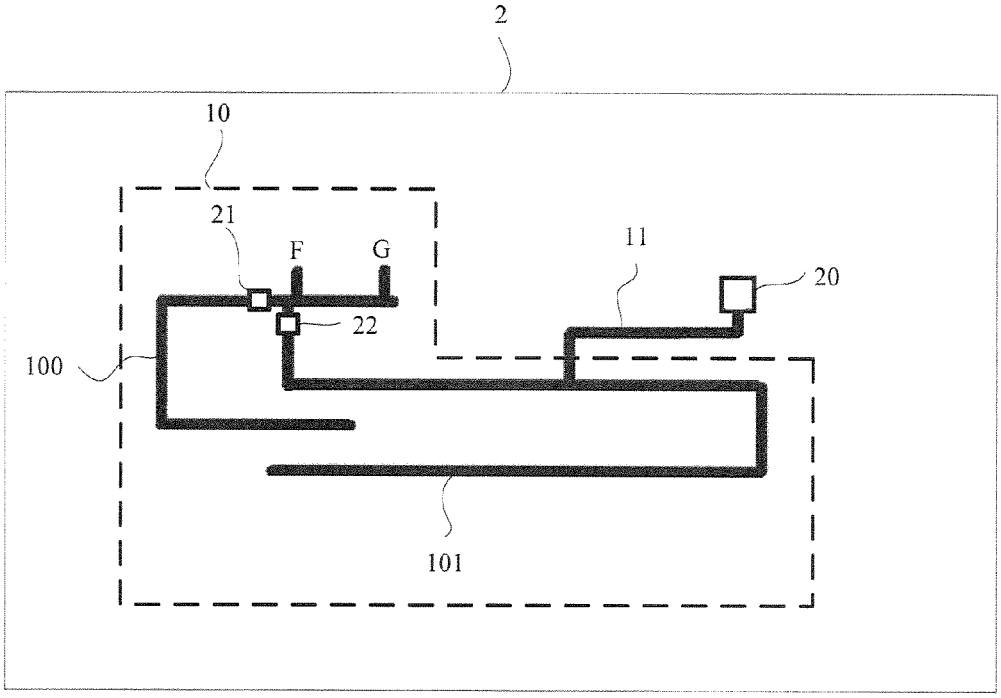
FIG. 2*a* is a schematic structural diagram of an antenna apparatus according to Embodiment 2 of the present invention.

FIG. 2*a* is a schematic structural diagram of an antenna apparatus according to Embodiment 2 of the present invention. As shown in FIG. 2*a*, the antenna apparatus 2 includes: an antenna body 11, a stub 11, and a filtering matching device 20.

Specifically, the antenna body 10 includes a first branch 100 used to radiate a high-frequency signal and a second branch 101 used to radiate a low-frequency signal. A first feeding connection end 21 is disposed on the first branch 100, and a second feeding connection end 22 is disposed on the second branch 101. Both of the first feeding connection end 21 and the second feeding connection end 22 are configured to be connected to a feed (Feed), that is, F in FIG. 2*a*, of a feeder, and the feeder is configured to provide an input signal for the antenna apparatus 2.

Further, the filtering matching device 20 is connected to a free end of the stub 11. The filtering matching device 20 is a low-cut high-pass filtering network determined according to a specified high frequency, and is configured to better match radiation that the antenna apparatus 1 performs on a high frequency signal.

Optionally, the length of the stub 11 may be ¼ of a wavelength corresponding to the specified high frequency. Certainly, in practice, the length of the stub 11 is generally selected to be near ¼ of the wavelength corresponding to the specified high frequency at which the antenna apparatus 1 works.

Optionally, the antenna body 10 may be an inverted F antenna (Inverted F Antenna, IFA for short), and in particular, the antenna body 10 may be a planar inverted F antenna (PIFA).

Figure 2B:
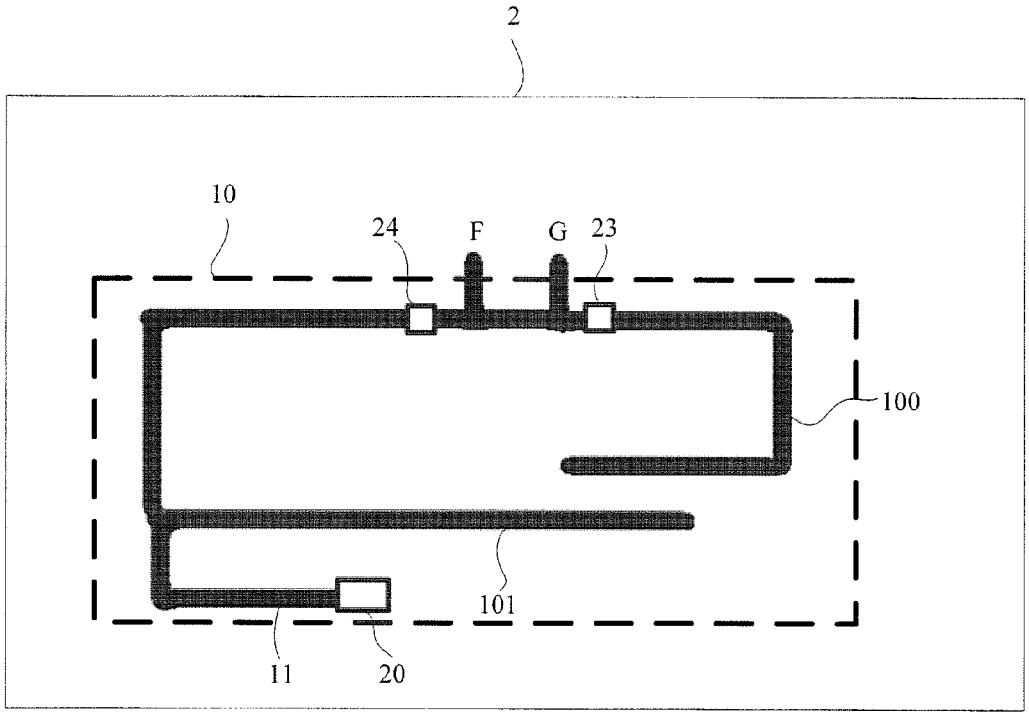
FIG. 2*b* is a schematic structural diagram of another antenna apparatus according to Embodiment 2 of the present invention.
Figure 2C:
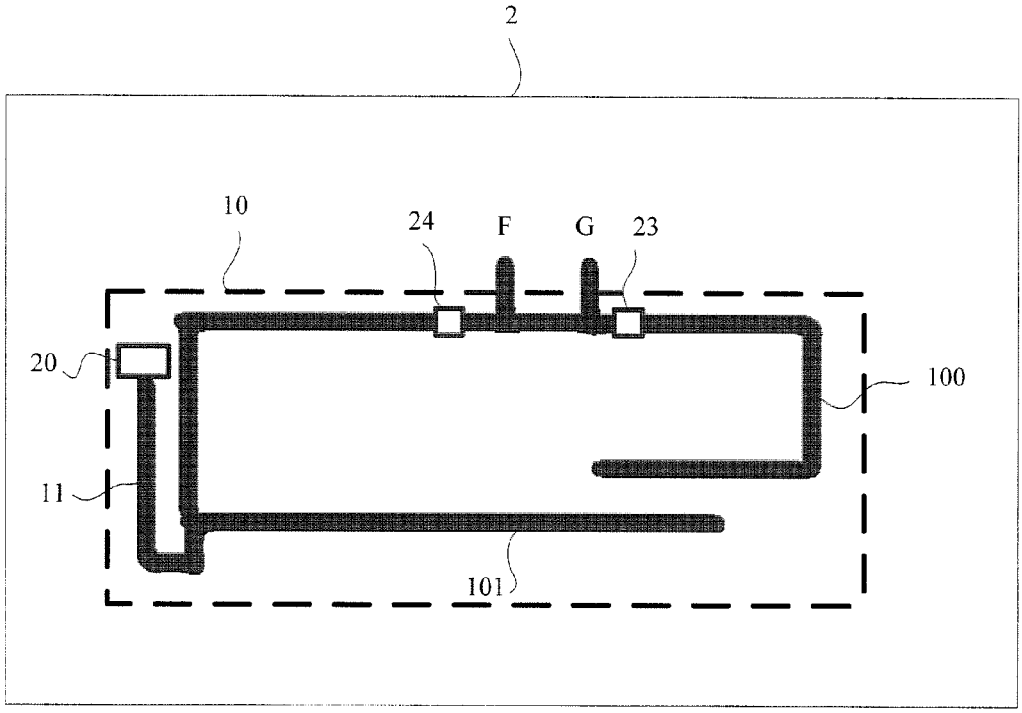
FIG. 2*c* is a schematic structural diagram of yet another antenna apparatus according to Embodiment 2 of the present invention.

Certainly, in FIG. 2*a*, both of the first branch 100 and the second branch 101 are connected to and extend from the feeder. In practice, the first branch 100 and the second branch 101 may be respectively connected to the feed F of the feeder and a ground end G (Ground), that is, G in FIG. 2*a*, of a terminal at which the antenna apparatus 2 is located. FIG. 2*b* is a schematic structural diagram of another antenna apparatus according to Embodiment 2 of the present invention. As shown in FIG. 2*b*, a ground connection end 23 is disposed on a first branch 100 of the antenna apparatus 2, and a third feeding connection end 24 is disposed on a second branch 101. The ground connection end 23 is connected to a ground end G of the terminal at which the antenna apparatus 2 is located, and the third feeding connection end 24 is connected to a feed of a feeder. Certainly, an antenna apparatus similar to the antenna apparatus of FIG. 2*b* may have a structure shown in FIG. 2*c*. FIG. 2*b* and FIG. 2*c* only differ in bending directions of stubs. In practice, a corresponding structure may be selected according to an actual situation, and details are not described herein again.

Figure 2D:
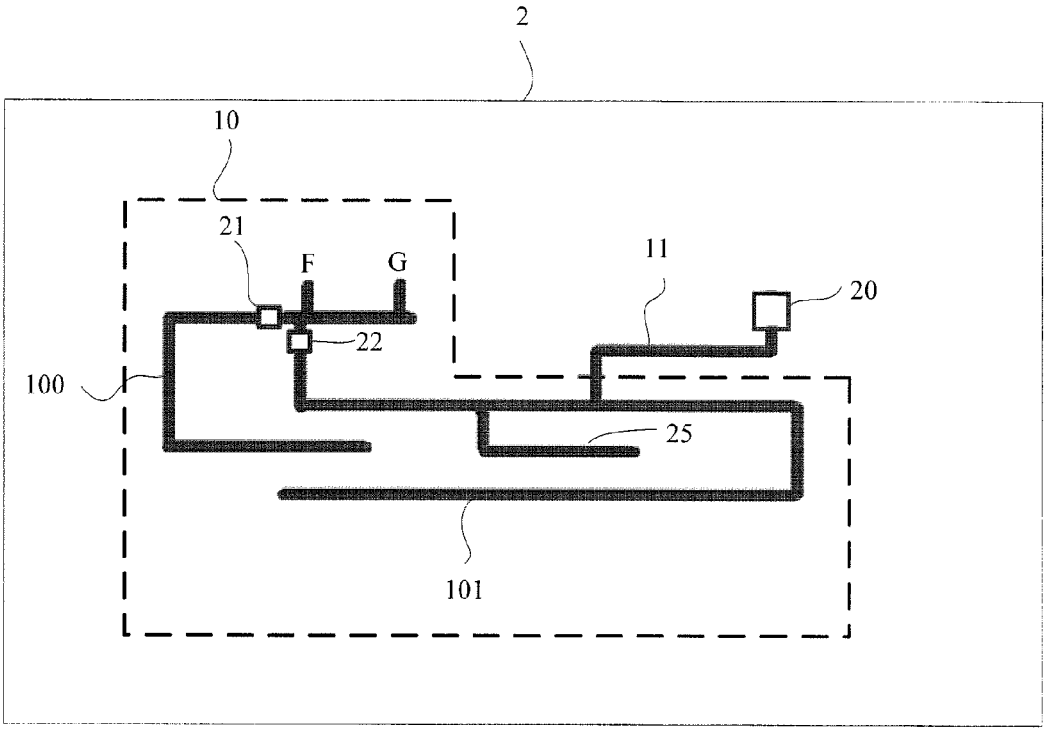
FIG. 2*d* is a schematic structural diagram of still another antenna apparatus according to Embodiment 2 of the present invention.

Besides, in FIG. 2*a* to FIG. 2*c*, description is made by using one stub 11 as an example. In practice, there may be several stubs. FIG. 2*d* provides a schematic structural diagram of still another antenna apparatus on the basis of the antenna apparatus 2 provided in FIG. 2*a*. As compared with FIG. 2*a*, one stub 25 is added to the antenna apparatus 2. Certainly, the stub 25 is at a position with a maximum value of current distribution on a second branch 101 of a wavelength corresponding to a specified high frequency at which the antenna apparatus 2 works. Just as described in Embodiment 1, in practice, a quantity of stubs may be determined according to actual requirements. In FIG. 2*b* and FIG. 2*c*, several stubs may be further added. In addition, a free end of the stub 25 in FIG. 2*d* may be connected to a filtering matching device, which is not drawn and described herein again.

Besides, in FIG. 2*a* to FIG. 2*d*, the free end of the stub 11 may be enabled to near the second branch 101, that is, may be bent towards the second branch 101. Just as described in Embodiment 1, the length of the stub 11 is determined according to the specified high frequency, and in practice, an antenna apparatus works at a frequency band, and therefore, the enabling the free end of the stub 11 to near the second branch 101 can cancel a current distribution error caused because the antenna apparatus works at a frequency other than the specified high frequency, which is not drawn and described herein again.

The antenna apparatus 2 provided in the embodiment of the present invention includes an antenna body 10 and a stub 11, where the antenna body 10 includes a first branch 100 used to radiate a high-frequency signal and a second branch 101 used to radiate a low-frequency signal; one end of the stub 11 is connected to a connection point of the second branch 101, and the other end of the stub 11 is a free end; the connection point is a position with a maximum value of current distribution on the second branch 101 of a wavelength corresponding to a specified high frequency at which the antenna apparatus works; and the length of the stub 11 is determined according to the wavelength corresponding to the specified high frequency. By means of the technical solution provided in the embodiment of the present invention, antenna performance can be improved while occupying relatively small space.

Figure 3:
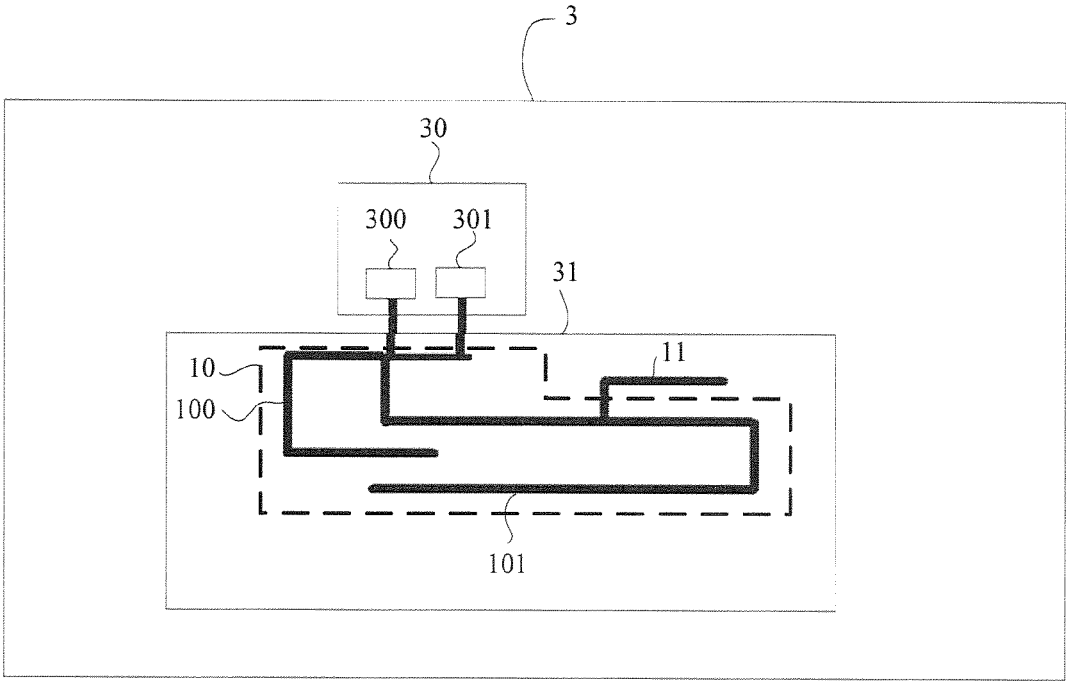
FIG. 3 is a schematic structural diagram of a terminal according to Embodiment 3 of the present invention.

FIG. 3 is a schematic structural diagram of a terminal according to Embodiment 3 of the present invention. As shown in FIG. 3, the terminal 3 includes: a printed circuit board 30 and an antenna apparatus 31.

Specifically, a feeder 300 and a ground end 301 are disposed on the printed circuit board 30, and the antenna apparatus 31 may be any antenna apparatus described in Embodiment 1 and Embodiment 2. The antenna apparatus 31 being the antenna apparatus 1 in Embodiment 1 is used as an example, where a first branch 100 in the antenna apparatus 31 is connected to the feeder 300, and a second branch 101 is connected to the feeder 300; or a first branch 100 in the antenna apparatus is connected to the ground end 301, and a second branch 101 is connected to the feeder 300. The schematic structural diagram of the terminal 3 when the second branch 101 is connected to the feeder 300 is shown herein by only using the antenna apparatus 1 provided in FIG. 1 as an example. Neither another connection manner of the first branch 100 and the second branch 101, nor any one of other antenna apparatuses described in Embodiment 1 and Embodiment 2 is drawn or described again.

The terminal 3 provided in the embodiment of the present invention includes an antenna body 10 and a stub 11, where the antenna body 10 includes a first branch 100 used to radiate a high-frequency signal and a second branch 101 used to radiate a low-frequency signal; one end of the stub 11 is connected to a connection point of the second branch 101, and the other end of the stub 11 is a free end; the connection point is a position with a maximum value of current distribution on the second branch 101 of a wavelength corresponding to a specified high frequency at which the antenna apparatus works; and the length of the stub 11 is determined according to the wavelength corresponding to the specified high frequency. By means of the technical solution provided in the embodiment of the present invention, antenna performance can be improved while occupying relatively small space.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A terminal, comprising:

a printed circuit board; and an antenna apparatus, comprising:

an antenna body comprising a first branch used to radiate a high-frequency signal and a second branch used to radiate a low-frequency signal, and a first stub, wherein a first end of the first stub is connected to a first connection point of the second branch, and a second end of the first stub is a free end, wherein the first connection point is a first position with a maximum value of current distribution on the second branch of an electromagnetic wave having a wavelength, the wavelength corresponding to a specified high frequency at which the antenna apparatus works, and the length of the first stub is determined according to the wavelength corresponding to the specified high frequency.

2. The terminal according to claim 1, wherein the antenna apparatus further comprises:

a second stub, wherein a first end of the second stub is connected to a second connection point of the second branch, and a second end of the second stub is a free end, wherein the second connection point is a second position with the maximum value of current distribution on the second branch of the electromagnetic wave having the wavelength, the wavelength corresponding to the specified high frequency at which the antenna apparatus works, and the length of the second stub is determined according to the wavelength corresponding to the specified high frequency.

3. The terminal according to claim 2, wherein the free end of the second stub is near the second branch.

4. The terminal according to claim 2, further comprising:

a filtering matching device connected to the free end of the second stub.

5. The terminal according to claim 2, wherein the length of the second stub is ¼ of the wavelength corresponding to the specified high frequency.

6. The terminal according to claim 1, wherein a first feeding connection end is disposed on the first branch, and a second feeding connection end is disposed on the second branch.

7. The terminal according to claim 1, wherein a ground connection end is disposed on the first branch, and a third feeding connection end is disposed on the second branch.

8. The terminal according to claim 1, wherein a fourth feeding connection end is disposed on the first branch, and a ground connection end is disposed on the second branch.

9. The terminal according to claim 1, wherein the free end of the first stub is near the second branch.

10. The terminal according to claim 1, further comprising:

a filtering matching device connected to the free end of the first stub.

11. The terminal according to claim 10, wherein the filtering matching device is a low-cut high-pass filtering device determined according to the specified high frequency.

12. The terminal according to claim 1, wherein the length of the first stub is ¼ of the wavelength corresponding to the specified high frequency.

13. The terminal according to claim 1, wherein the length of the first stub is ½ of the wavelength corresponding to the specified high frequency.

14. The terminal according to claim 1, wherein the antenna body is an inverted F antenna (IFA).

15. The terminal according to claim 1, wherein a feeder end and a ground end are disposed on the printed circuit board, the first branch in the antenna apparatus is connected to the feeder end, and the second branch is connected to the feeder end.

16. The terminal according to claim 1, wherein a feeder end and a ground end are disposed on the printed circuit board, the first branch in the antenna apparatus is connected to the ground end, and the second branch is connected to the feeder end.

17. An antenna apparatus, comprising:

an antenna body comprising a first branch used to radiate a high-frequency signal and a second branch used to radiate a low-frequency signal; and a first stub, wherein a first end of the first stub is connected to a first connection point of the second branch, and a second end of the first stub is a free end, wherein the first connection point is a first position with a maximum value of current distribution on the second branch of an electromagnetic wave having a wavelength, the wavelength corresponding to a specified high frequency at which the antenna apparatus works, and the length of the first stub is determined according to the wavelength corresponding to the specified high frequency.

18. The antenna apparatus according to claim 17, further comprising:

a second stub, wherein a first end of the second stub is connected to a second connection point of the second branch, and a second end of the second stub is a free end, wherein the second connection point is a second position with the maximum value of current distribution on the second branch of the electromagnetic wave having the wavelength, the wavelength corresponding to the specified high frequency at which the antenna apparatus works, and the length of the second stub is determined according to the wavelength corresponding to the specified high frequency.

19. The antenna apparatus according to claim 17, further comprising:

a filtering matching device connected to the free end of the first stub.

20. The antenna apparatus according to claim 17, wherein the length of the first stub is ¼ of the wavelength corresponding to the specified high frequency.

* * * * *